United States Patent [19]

Hansen

[11] 4,034,707

[45] July 12, 1977

[54] APPARATUS FOR COATING WEBS

[75] Inventor: Edwin S. Hansen, Worcester, Mass.

[73] Assignee: Rice Barton Corporation, Worcester, Mass.

[21] Appl. No.: 646,526

[22] Filed: Jan. 5, 1976

[51] Int. Cl.[2] ..... B05C 3/18

[52] U.S. Cl. ..... 118/407

[58] Field of Search ..... 118/407, 413, 261, 259, 118/412; 101/363, 350

[56] References Cited

U.S. PATENT DOCUMENTS

| | | | |
|---|---|---|---|
| 2,593,074 | 4/1952 | Trist | 118/413 |
| 2,918,899 | 12/1959 | Munton et al. | 118/413 |
| 3,030,917 | 4/1962 | Brown et al. | 118/413 |
| 3,079,889 | 3/1963 | Jacobs et al. | 118/259 X |
| 3,179,536 | 4/1965 | Martinek | 118/407 X |
| 3,331,351 | 7/1967 | Werner | 118/407 |
| 3,936,549 | 2/1976 | Kohler et al. | 118/407 X |

*Primary Examiner*—John P. McIntosh

[57] ABSTRACT

In apparatus for coating a web, comprising a backup member having an axis, a coating head for receiving coating material and applying it to a web supported by the member for movement transverse to the axis, the head including portions defining the rear and bottom walls of a coating chamber; and a dike system for confining the coating material in the chamber, the system comprising a pair of inboard dikes spaced apart along the axis, each inboard dike having a control surface shaped to conform to the backup member along a margin of the web and having an operating position in which the control surface is spaced from the backup member sufficiently to allow the coating material to bleed between the control surface and the web to coat the margin, the control surface in the operating position being sufficiently close to the backup member to confine most of the coating material to between the inboard dikes; and a pair of outboard dikes respectively spaced outwardly from the inboard dikes along the axis, the outboard dikes each having a sealing surface and an operating position in which the sealing surface is in sealing contact with the backup member to prevent leakage of the coating material bleeding past the inboard dikes; the head being provided with drainage openings for draining the coating material from the zones between the inboard and outboard dikes; that improvement wherein the ends of the backup member are beveled to provide surfaces oblique to the axis, and the outboard dikes are beveled to cause said sealing surfaces to be parallel to and sealingly mate with the oblique surfaces of the backup member.

5 Claims, 14 Drawing Figures

APPARATUS FOR COATING WEBS

BACKGROUND OF THE INVENTION

This invention relates to web coating apparatus of the sort in which coating material is supplied to a coater head (usually having a doctor blade) for application to a moving web supported on a backup roll. The body of the head provides the rear wall and floor of a coating chamber, and dikes are provided to close the ends of the chamber and seal against the backup roll. Typically the dikes will seal against the margins of the web, preventing the coating from rolling over to the other side of the web; in such cases the web will have uncoated margins, which are usually trimmed.

In a copending U.S. patent application, Ser. No. 646,527, now abandoned, entitled COATING WEBS, filed on the same day as this application by F. Peter Ford, there is disclosed and claimed Mr. Ford's invention of a dike system comprising a pair of inboard dikes spaced along the backup member axis, each inboard dike having a control surface shaped to conform to the backup member along a margin of the web and having an operating position in which the control surface is spaced from the backup member sufficiently to allow the coating material to bleed between the control surface and the web to coat the margin, the control surface in the operating position being sufficiently close to the backup member to confine most of the coating material to between the inboard dikes, and a pair of outboard dikes respectively spaced outwardly from the inboard dikes along the axis, the outboard dikes each having a sealing surface and an operation position in which the sealing surface is in sealing contact with the backup member to prevent leakage of the coating material bleeding past the inboard dikes, the head being provided with drainage openings for draining the coating material from the zones between the inboard and outboard dikes.

SUMMARY OF THE INVENTION

The present invention is an improvement upon Mr. Ford's invention. The invention provides improved sealing between the outboard dikes and the backup roll and doctor blade. Roll wear is further minimized.

In general the invention features, in one aspect, an arrangement wherein the ends of the backup member are beveled to provide surfaces oblique to the axis, and the outboard dikes are beveled to cause the sealing surfaces to be parallel to and sealingly mate with the oblique surfaces of the backup member. In another aspect the invention features resilient portions of the outboard dikes located beyond and in sealing contact with the outer edges of a doctor blade, said resilient portions also providing the sealing surfaces of the outboard dikes. In preferred embodiments each outboard dike includes a first rigid portion mounted on the head and a second rigid portion mounted on the first rigid portion and moveable relative thereto toward and away from the backup member, the second rigid portion carrying a resilient portion providing the sealing surface.

Other advantages and features of the invention will be apparent from the description and drawings herein of a preferred embodiment.

DESCRIPTION OF THE PREFERRED EMBODIMENT

Figure 2:
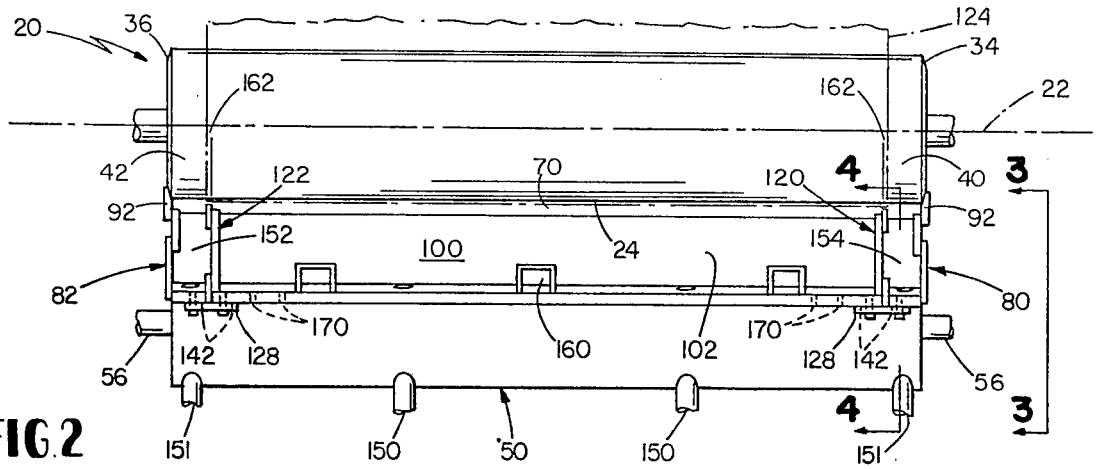
FIG. 2 is a top plan view of the apparatus of FIG. 1.
Figure 5:
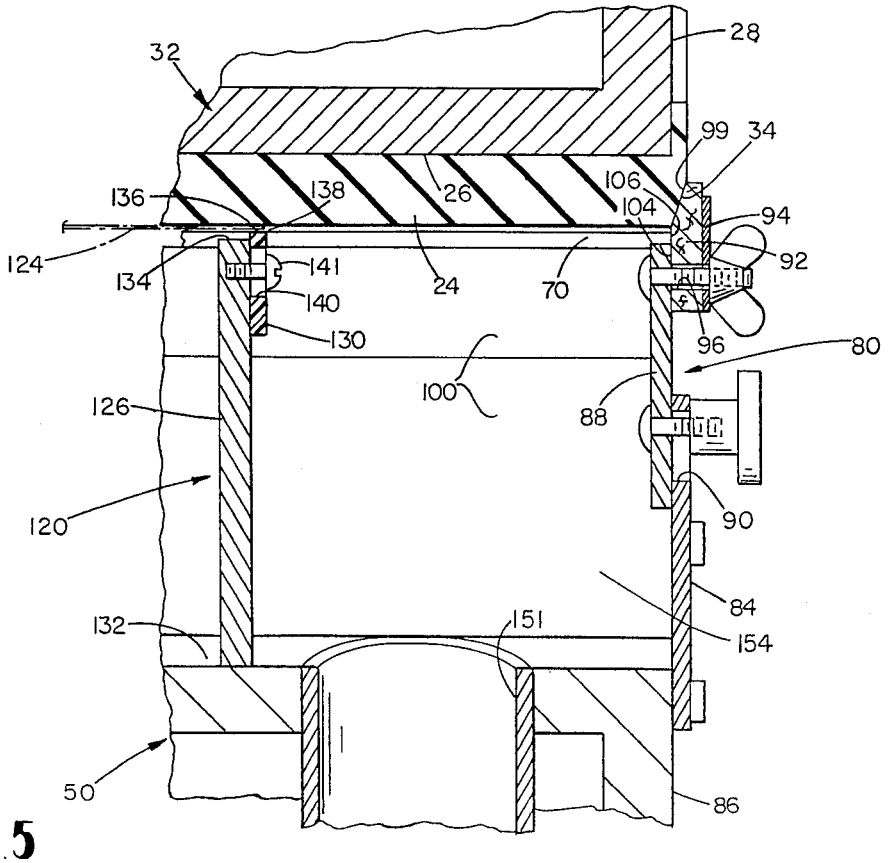
FIG. 5 is a sectional view taken along 5—5 of FIG. 3.

Referring to the drawings, coater backup roll 20 is mounted for rotation about axis 22 and has a 1 inch thick rubber cover 24 (FIG. 5) extending over the cylindrical surface 26 and end faces 28 (only one shown) of metal drum 32. Cover 24 is beveled at its ends to provide dike sealing surfaces 34 and 36 (FIG. 2, 5) which extend outwardly from the planes of faces 28 at about 75° to axis 22. The rubber has a hardness of 0–2 P & J in zones 40 and 42 which extend in 4 inches from each end of the roll, and otherwise has a hardness of 70 P & J.

Figure 1:
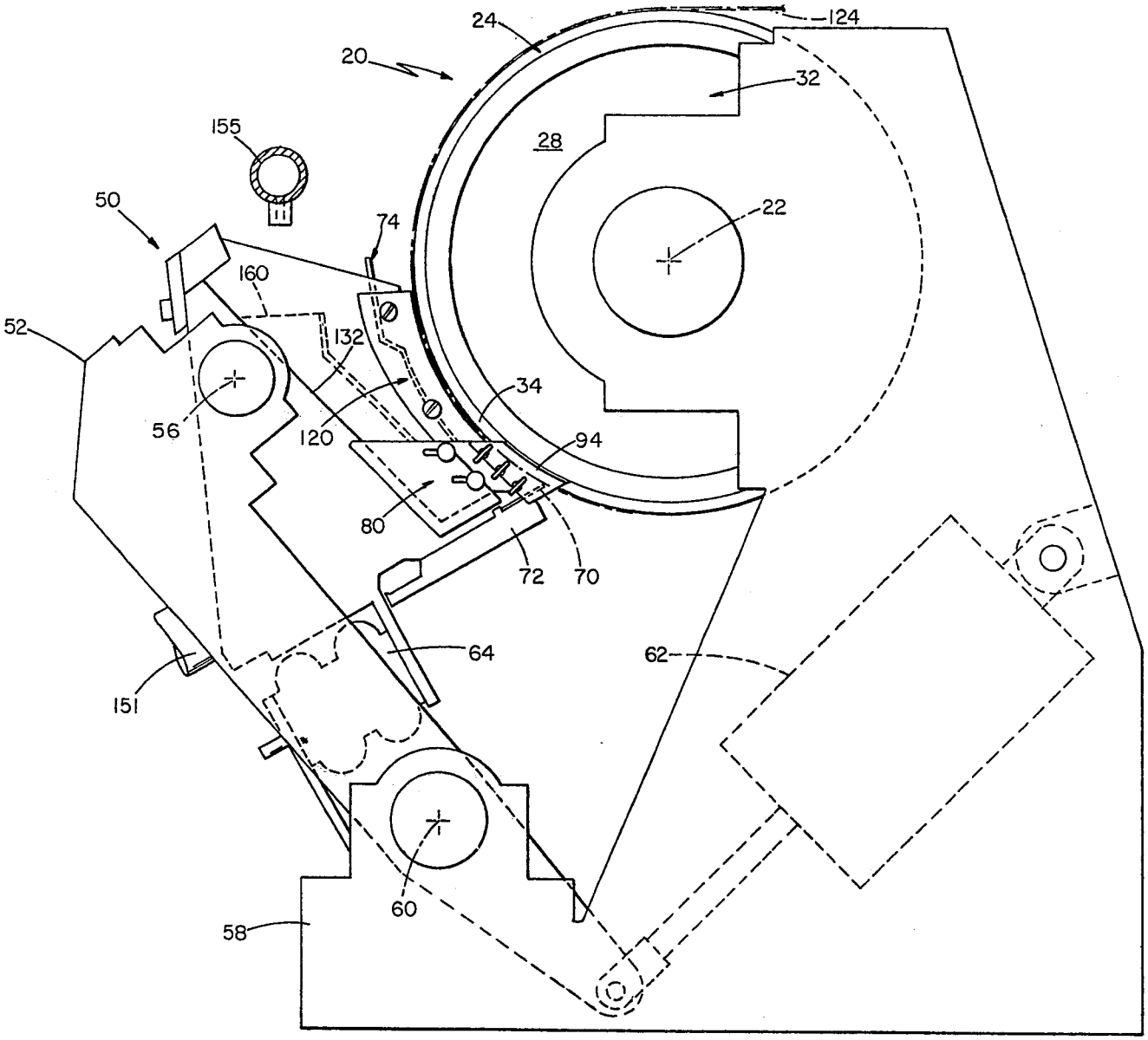
FIG. 1 is a semi-schematic end view of a coating apparatus embodying the invention.
Figure 4:
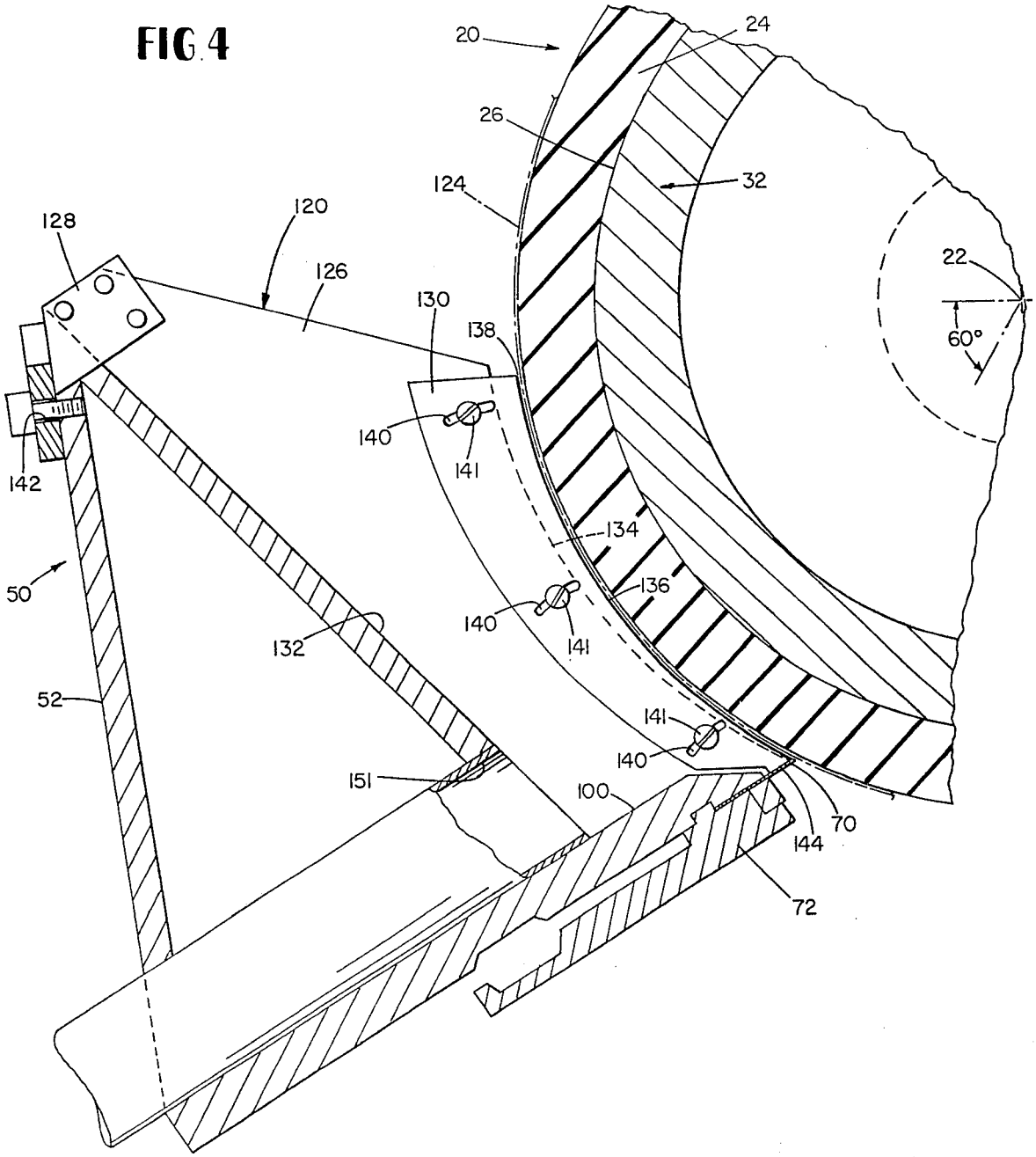
FIG. 4 is an enlarged sectional view taken along 4—4 of FIG. 2.

Coater head 50 (stainless steel) is mounted between arms 52 (FIG. 1, only one shown) for pivotal movement about axis 56. The arms are in turn pivotally mounted on frame 58 for movement about axis 60. Air cylinders 62 extend between the frame and the arms to control the position of the arms, and air springs 64 extend between the arms and the head to load the head in its operating position. Doctor blade 70 is clamped in jaw 72 at the front of head 50. The orientation of the head is such that the doctor blade points upwardly toward roll 20 and, in operation, contacts the web on the roll at about 60° below the horizontal plane including the roll axis 22 (FIG. 4). A conventional, perforated anti-turbulence baffle 74 (FIG. 1), conforming to the curvature of roll 20, is also mounted on head 50, spaced about 2 inches from the roll.

Figure 3:
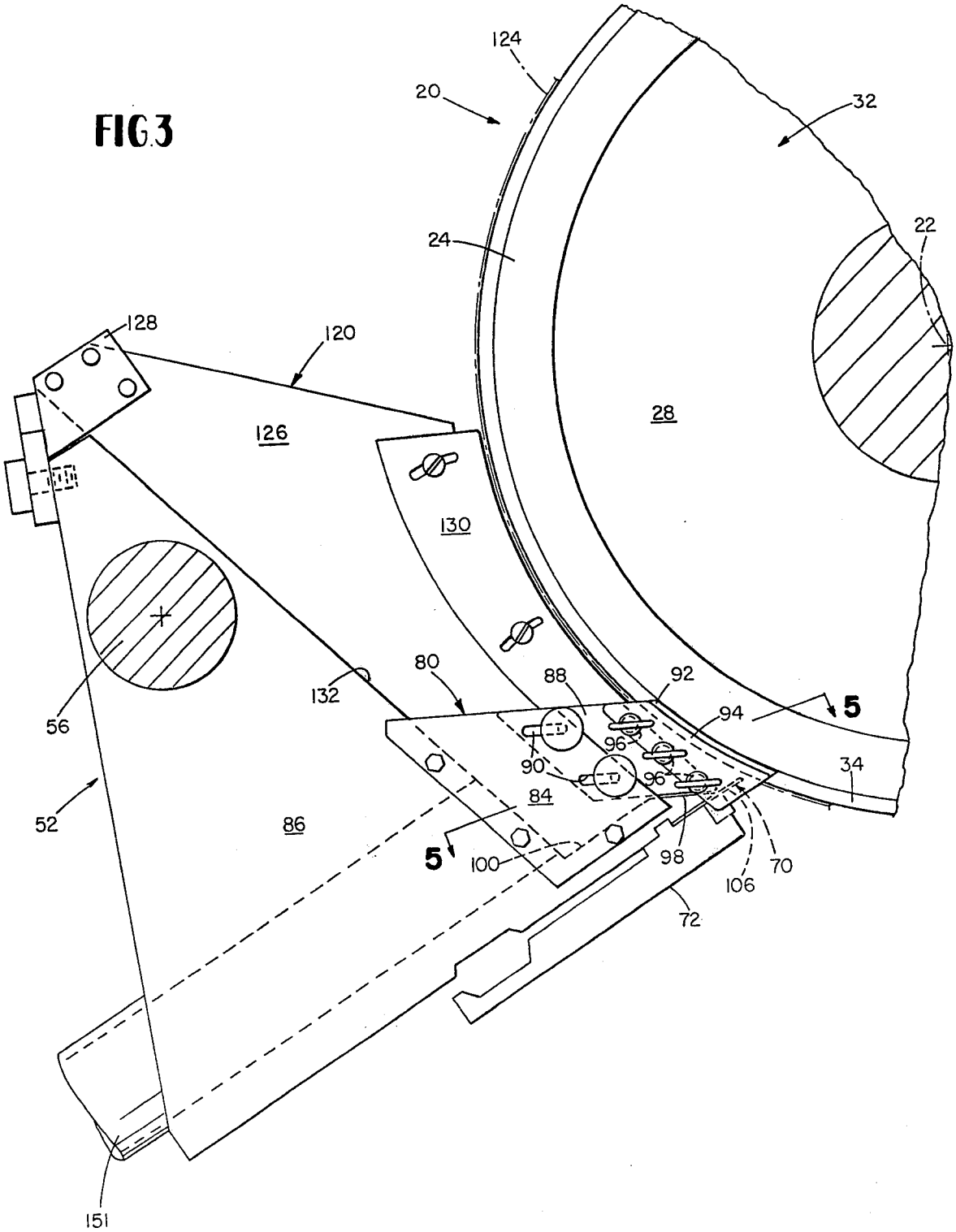
FIG. 3 is an enlarged end view taken along 3—3 of FIG. 2.

Outboard dikes 80 and 82 (FIG. 2) are provided at the ends of head 50. Referring to representative dike 80 (FIGS. 3, 5), it consists of a stainless steel end plate 84 fixed to the end face 86 of the head to form a metal-to-metal seal therewith, an intermediate stainless steel plate 88 adjustably bolted to the inner surface of plate 84 in horizontally elongated slots 90, and compressible seal 92 (e.g., of conventional latex filled felt material) having an outside thin stainless steel backing 94 and bolted to plate 88 in enlarged holes 96 to permit fine adjustment. The outer part of the bottom surface of plate 88 is beveled at 98 (FIG. 3) to permit the insertion of sealing material (e.g., duck) between it and the floor 100 of the coating chamber 102. Seal 92 has a curved and beveled sealing surface 99 located to contact roll surface 34 across its full width. The outer surface of plate 88, the inner surface 104 of felt 92, and the outer edge 106 of doctor blade 70, all lie in the plane of drum end face 28. Felt 92 extends below and to the rear of the portion of blade 70 protruding from jaw 72, to thereby form an end seal against the blade edge and the jaw.

Inboard dikes 120 and 122 are mounted in head 50 inwardly of dikes 80 and 82, and can be adjusted toward or away from the outboard dikes for alignment with the margins of the particular web 124 of sheet material being coated. Referring to representative dike 120 (FIG. 4), it consists of a flat stainless steel plate 126 bolted to racket 128 which in turn is bolted to the back of head 50, and a teflon non-contacting seal 130 bolted against the outside surface of plate 126. Plate 126 is shaped to provide a tight metal-to-metal seal against the rear wall 132 and floor 100 of head 50, including the upper surface of blade 70, but terminates in a curved surface 134 spaced from roll 20. The gap between surface 134 and the roll enlarges in the direction away from the blade. Seal 130 extends beyond surface 134 in the direction of the roll, and terminates in curved control surface 136 spaced from the roll by a uniform gap 138 of about 1/16 inch. Seal 130 has enlarged slots 140 through which bolts 141 pass into blind holes in plate 126 to permit fine adjustment of gap 138 while preserving a smooth inside surface on the plate. Bracket 128 has enlarged slots 142 through which it is bolted to head 50 to permit adjustment of the dike along roll axis 22. The bottom surface 144 of seal 130 seals tightly against blade 70.

Drainage/recirculation openings 150, each with an adjustable diaphragm valve (not shown), are provided in the back of head 50, between the inboard dikes. A drainage opening 151 is provided in each zone 152 and 154 between an inboard and outboard dike.

Baffle 74 is of course located wholly between the inboard dikes.

Supply pipe 155 feeds coating material to feed troughs 160 spaced in a staggered relationship with drainage/recirculation openings 150 to give uniform distribution of the coating into the zone of chamber 102 between the inboard dikes.

All stainless steel surfaces forming the interior of chamber 102 or participating in a metal-to-metal seal are polished.

A liquid level sensor (not shown) is mounted in chamber 102 to control the coating pond level to within ½ inch.

Conventional drive, web handling, and other conventional related elements of the apparatus described are provided, and are not shown.

For operation, the inboard dikes are adjusted so that seals 130 have their control surfaces 136 aligned with the marginal portions 162 of web 124 and located as close to the roll surface as possible without actually contacting the web. A 1/16 inch width for gap 138 is a convenient choice which ensures that as the doctor blade wears or deflects the inboard dikes will still not contact the web. Outboard dike seals 92 are adjusted to be in compression against the head, the doctor blade, and surfaces 34 and 36 of the roll cover. With the doctor blade loaded against the rotating roll, coating material is supplied to chamber 102 and is applied to the moving web. The inboard dikes retain most of the coating material between them. However, a small amount of coating bleeds through between seals 130 and the web and collects in zones 150 and 154, for ultimate drainage through the openings 151 communicating with those zones. In this way, coating is applied to marginal portions 162 of the web, so that the web is uniformly coated from the edge. An important advantage of the circulation of coating material past the inboard dikes is that stagnant zones of the coating adjacent the dikes, leading to dehydration and accumulation of hardened residue in the head, are avoided. Control surfaces 136 also prevent the web from floating away from the roll surface and prevent roll over of the coating material to the reverse side of the web. Because the inboard dikes do not contact the roll, damage to its soft rubber surface is prevented. Because only a small volume of coating material flows to the outboard dikes, an absolute seal may easily be maintained there, with relatively low dikes. The use of beveled sealing surfaces at the harder zones of the roll cover avoids the problem of the felts wearing into the cylindrical roll surface, and makes possible easy adjustment to compensate for wear of the felt. The quality of the absolute seal is also improved because, since the outboard dikes need not be adjusted laterally for different web widths, the felt can seal against the outer edges of the doctor blade rather than its top surface.

Additional holes 170 are provided at the back of head 50 for mounting brackets 128 at other positions, for webs of substantially different widths, where slots 142 do not permit sufficient adjustment.

The use of metal-to-metal sealing between the inboard dikes and the interior surfaces of the head facilitate adjustment and cleaning. The smooth inside surfaces of plates 126 (brackets 128 are above the pond level) also facilitate cleanup.

Other embodiments are within the following claims.

What is claimed is:

1. In apparatus for coating a web, comprising a backup member having an axis; a coating head for receiving coating material and applying it to a web supported by said member for movement transverse to said axis, said head including portions defining the rear and bottom walls of a coating chamber; and a dike system for confining said coating material in said chamber, said system comprising a pair of inboard dikes spaced apart along said axis, each said inboard dike having a control surface shaped to conform to said backup member along a margin of said web and having an operating position in which said control surface is spaced from said backup member sufficiently to allow said coating material to bleed between said control surface and said web to coat said margin, said control surface in said operating position being sufficiently close to said backup member to confine most of said coating material to between said inboard dikes; and a pair of outboard dikes respectively spaced outwardly from said inboard dikes along said axis, said outboard dikes each having a sealing surface and an operating position in which said sealing surface is in sealing contact with said backup member to prevent leakage of said coating material bleeding past said inboard dikes;

said head being provided with drainage openings for draining said coating material from the zones between said inboard and outboard dikes;

that improvement wherein the ends of said backup member are beveled to provide surfaces oblique to said axis, and said outboard dikes are beveled to cause said sealing surfaces to be parallel to and sealingly mate with said oblique surfaces of said backup member.

2. The improvement of claim 1 wherein said backup member is a drum having a rubbery cover, end portions of said cover being harder than the rubber between said end portions, said end portions including said oblique surfaces.

3. The improvement of claim 1 wherein said head includes a doctor blade, and said outboard dikes include resilient portions located beyond and in sealing contact with the outer edges of said blade, said resilient portions providing said sealing surfaces.

4. The improvement of claim 1 wherein each said outboard dike includes a first rigid portion mounted on said head and a second rigid portion mounted on said first rigid portion and moveable relative thereto toward and away from said backup member, said second rigid portion carrying a resilient portion providing said sealing surface.

5. In apparatus for coating a web, comprising a backup member having an axis; a coating head for receiving coating material and applying it to a web supported by said member for movement transverse to said axis, said head including portions defining the rear and bottom walls of a coating chamber; and a dike system for confining said coating material in said chamber, said system comprising a pair of inboard dikes spaced apart along said axis, each said inboard dike having a control surface shaped to conform to said backup member along a margin of said web and having an operating position in which said control surface is spaced from said backup member sufficiently to allow said coating material to bleed between said control surface and said web to coat said margin, said control surface in said operating position being sufficiently close to said backup member to confine most of said coating material to between said inboard dikes; and a pair of outboard dikes respectively spaced outwardly from said inboard dikes along said axis, said outboard dikes each having a sealing surface and an operating position in which said sealing surface is in sealing contact with said backup member to prevent leakage of said coating material bleeding past said inboard dikes;

said head being provided with drainage openings for draining said coating material from the zones between said inboard and outboard dikes;

that improvement wherein said head includes a doctor blade, and said outboard dikes include resilient portions located beyond and in sealing contact with the outer edges of said blade, said resilient portions providing said sealing surfaces.

* * * * *